United States Patent [19]

Kaugars et al.

[11] 4,288,075

[45] Sep. 8, 1981

[54] ULTRA LIGHT WEIGHT GOLF CLUB SHAFT

[75] Inventors: Eugene Kaugars; George A. Ossola, both of Torrington, Conn.

[73] Assignee: Brunswick Corporation, Skokie, Ill.

[21] Appl. No.: 69,796

[22] Filed: Aug. 27, 1979

[51] Int. Cl.[3] ..... A63B 53/12

[52] U.S. Cl. ..... 273/80 B

[58] Field of Search ..... 273/77 R, 77 A, 80 R, 273/80 B, 80.9, 81 R, 81 A, 80 A

[56] References Cited

U.S. PATENT DOCUMENTS

| | | | |
|---|---|---|---|
| 3,083,969 | 4/1963 | Bills | 273/80 B |
| 3,614,101 | 10/1971 | Hunter | 273/80 B X |
| 3,833,223 | 9/1974 | Shulkin | 273/80 B X |
| 3,871,649 | 3/1975 | Kilshaw | 273/77 A |
| 4,125,260 | 11/1978 | Kanne et al. | 273/80 R |
| 4,165,874 | 8/1979 | Lezatte | 273/80 B X |

FOREIGN PATENT DOCUMENTS

| | | | |
|---|---|---|---|
| 30050 | of 1912 | United Kingdom | 273/80 B |
| 1261541 | 1/1972 | United Kingdom | 273/80 R |

OTHER PUBLICATIONS

"Golf Digest;" Jun. 1977; p. 13.

*Primary Examiner*—Richard J. Apley

*Attorney, Agent, or Firm*—Fidelman, Wolffe & Waldron

[57] ABSTRACT

An ultra light weight golf club shaft tapered in a step pattern having a reinforced wall at the region where maximum bending moment occurs during play.

6 Claims, 4 Drawing Figures

ULTRA LIGHT WEIGHT GOLF CLUB SHAFT

CROSS-REFERENCE TO RELATED APPLICATION

This application is related to application Ser. No. 760,518 filed Jan. 19, 1977 now U.S. Pat. No. 4,169,595 by Kaugars entitled "Light Weight Golf Club Shaft," which is included herein by reference.

BACKGROUND OF THE INVENTION

This invention relates to a light weight golf club shaft formed of a high strength alloy and having a step pattern taper. A short concise background of golf club shafts developments is given in U.S. Pat. No. 4,169,595 to which recourse may be had.

DESCRIPTION OF THE PRIOR ART

Golf club shafts tapered in a step pattern are conventional and are illustrated, for example, by U.S. Pat. Nos. 1,670,531, 1,765,709, 1,974,389, 2,037,636 and 3,871,649. While these patents do not give the weight of the golf club shafts, standard carbon alloy steel shafts in common use typically have weights of about 4 ounces. As illustrations, the popular Propel TM, Propel II TM and Protaper TM standard flex golf club shaft weigh respectively 4.37, 4.42 and 3.98 ounces.

Ideally, a golf club should have substantially all of its weight concentrated in the club head and have a shaft and grip of negligible weight. In the ideal club substantially all of the swing effort would be concentrated as kinetic energy in the club head for transfer to the ball. A lessening of the shaft weight while retaining the requisite strength and resiliency is, accordingly, the goal sought in the improvement of golf club shafts and the resultant performance of golf clubs.

Light weight carbon steel alloy shafts have been produced in weight ranges of around 3.4 to 3.8 ounces with subtantially the same other physical properties as the standard weight shafts by lessening the wall thickness and devising a proper taper. These are described in U.S. Pat. No. 4,169,595, and represent a significant improvement over the prior art. Attempts to further lessen the shaft weight by making the shaft walls thinner still resulted in shafts lacking sufficient strength to resist maximum bending moments occurring during use by the average player.

It is the primary object of my invention to provide a metal, extra light weight golf club shaft of a generally thin wall thickness tapered in a step pattern and designed to resist the maximum shaft bending moment resulting from the force of the club head striking the golf ball, whereby the unit stresses at the region of maximum bending moment are of a magnitude which do not injure the shaft.

A further object of the invention is to provide shafts for a family of light weight golf clubs, each shaft tapered with a step pattern and reinforced at the region where maximum bending moment is developed during play, each club in the family having desirable playing characteristics.

A further object of the invention is to provide a hollow tubular golf club shaft of alloy steel having a grip portion of reduced internal diameter to provide a section of greater thickness, whereby to resist the maximum bending moment occuring during play.

SUMMARY OF THE INVENTION

In summary, this invention is directed to an alloy steel ultra light weight golf club shaft tapered in a step pattern having a weight of less than 3 ounces. At the grip portion of the shaft the wall thickness of the shaft tubing is made thicker to provide greater bending moment resistance.

THE INVENTION

The letters X, R, S and L are commonly employed in the golf club art to denote shaft stiffness characterictics. X stands for extra stiff, S for stiff, R for regular and L for ladies. These terms are relative and have no commonly accepted absolute definition. Determination of the X, R, S and L flexes in connection with the shafts of the invention is as described in detail in U.S. Pat. No. 4,169,595.

In attempting to reduce the weight of the golf club shaft the shaft tubing wall thickness was reduced. However, this resulted in a weakening of the shaft, leading to fatigue breaks in rough useage. Golf clubs made from such shafts, accordingly, proved unsuitable for use by the general public. Nevertheless such ultra light weight golf clubs with thin wall shafts weighing only 2.9 ounces have been used by expert golfers with some excellent results. As compared with drives with conventional weight clubs, drives of 20 to 30 yards longer have been claimed for the light weight clubs. These results indicated that reduction of the shaft weight would be highly desirable providing the shaft could be strengthened.

In play the greatest stress in the shaft occurs at the region of the grip. Here, at the instant when the club head strikes the golf ball the maximum bending moment—the product of the force imparted to the ball and the distance from the point of impact to the grip region—is produced. The maximum stress is then produced at the outer surface of the shaft in the grip region. We have found that by retaining the thin wall structure in the shaft below the grip region and by reinforcing the wall at the grip region the benefits of low weight can be retained while at the same time the weakest region of the shaft is strengthened.

Figure 1:
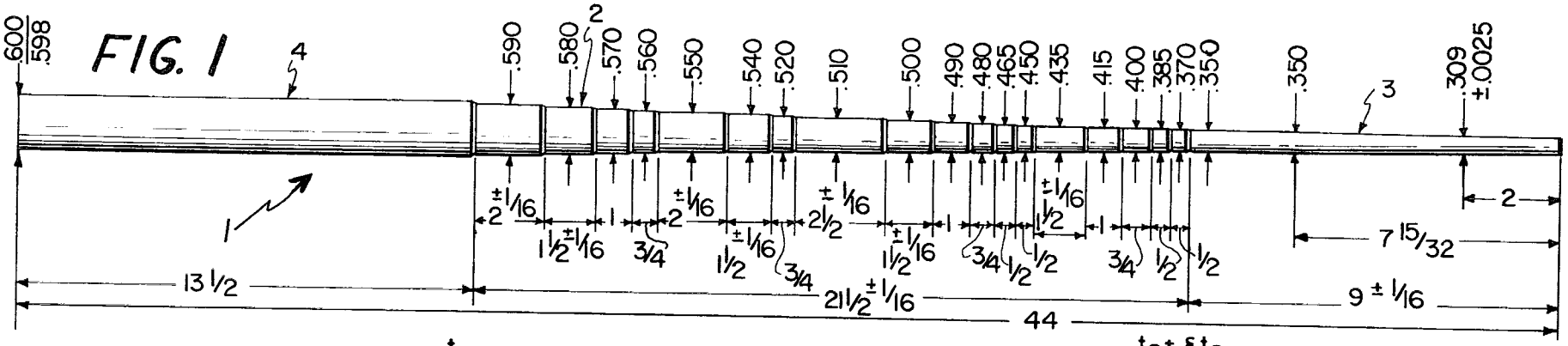
FIG. 1 is a plan view of a golf club shaft R stiffness, giving the dimensions.
Figure 2:
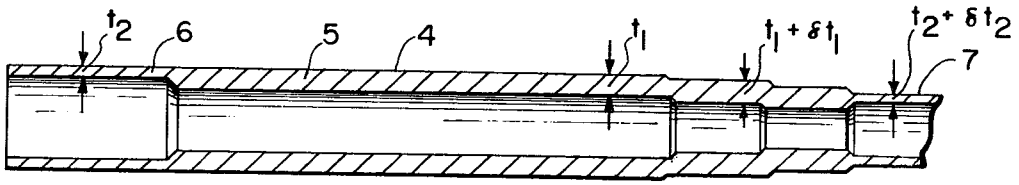
FIG. 2 is a longitudinal sectional view of the grip end of the shaft.

As shown in FIG. 1 shaft 1 comprises a step tapered midportion 2, and end portion 3 for mounting the club head and a grip section 4. A region at the grip 4 is reinforced as shown in FIG. 2. At the grip and extending into the first two steps of the taper the wall thickness is shown generally as $t_1$ at 5. At the left end of 5 is section 6 of the grip with a thickness $t_2$. The thickness for the rest of the shaft midportions indicated at 7 as generally $t_2$. The shaft portion of greater thickness is denoted herein as the grip portion.

Figure 4:
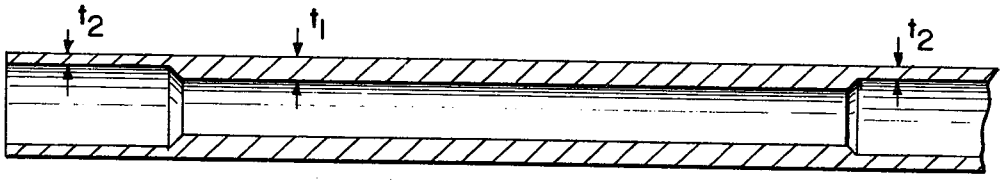
FIG. 4 is a longitudinal sectional view of the tube stock from which the stepped shaft is formed.

The stepped shaft is formed from tube stock, shown in FIG. 4, by hydraulic pushing process which reduces the tube outside diameter at predetermined step lengths. This causes elongation of the tube and a slight increase in wall thickness. Thus, the wall thicknesses of the first two steps of FIG. 2 are slightly more than thickness $t_1$ shown in FIG. 4 as indicated by $t_1+\delta t_1$. Going toward the club end the steps progressively have a slighly increasing wall thickness over $t_2$ of FIG. 4, as illustrated by the step in FIG. 2 having a wall thickness of $t_2+\delta t_2$.

Thus, the reinforcement consists of a length of reduced internal diameter at the grip portion, whereby a greater cross-sectional area and thus a greater moment of inertia result. The stress at the region of maximum bending moment is determined according to the formula $S=(MC/I)$, wherein S is the unit stress, M is the bending moment. C is the distance from the neutral axis to the outer boundary or fiber and I is the moment of inertia. Accordingly, increasing I decreases S; M and C being constant. The thicknesses $t_1$ and $t_2$ in FIGS. 2 and 4 are 0.010 and 0.0078 inches respectively and the length of the thickened portion extends from 5 inches from the end to the first two steps of the shaft. However, these dimensions for the grip region reinforcement may be varied without affecting the overall results providing the length is sufficient to cover the critical region, the thickness is sufficient to adequately increase the moment of inertia, and the overall weight is kept below 3.0 ounces. The shaft shown in FIG. 1 has a weight of 2.9 ounces.

A metal having a yield point after heat treatment of at least 235,000 lbs./in.$^2$ and an ultimate strength of at least 265,000 lbs./in.$^2$ meets the criteria for the shaft composition. Alloy steel AISI 6150 satisfies these requirements. Non-limiting examples of other alloy steels which may also be employed are AISI 4150 and AISI 8650.

The step pattern shown in FIG. 1 is designed to give a golfer approximately the same deflection feel as some of the most common conventional R golf club alloy steel shafts in use today, such as Propel II TM by Union or Dynamic TM by True Temper. Determination of shaft deflection characteristics, including permanent set, is discussed in application Ser. No. 760,518 and need not be repeated here. It should be noted that the permanent set of the shaft of FIG. 1 determined by the method of U.S. Pat. No. 4,169,595 is

| W | B | S |
|---|---|---|
| 10 | 4 | .100 |

In a similar manner the deflection characteristics of conventional X, S and L clubs are ascertained and proper step patterns are determined to meet the desired flex characteristics.

Figure 3:
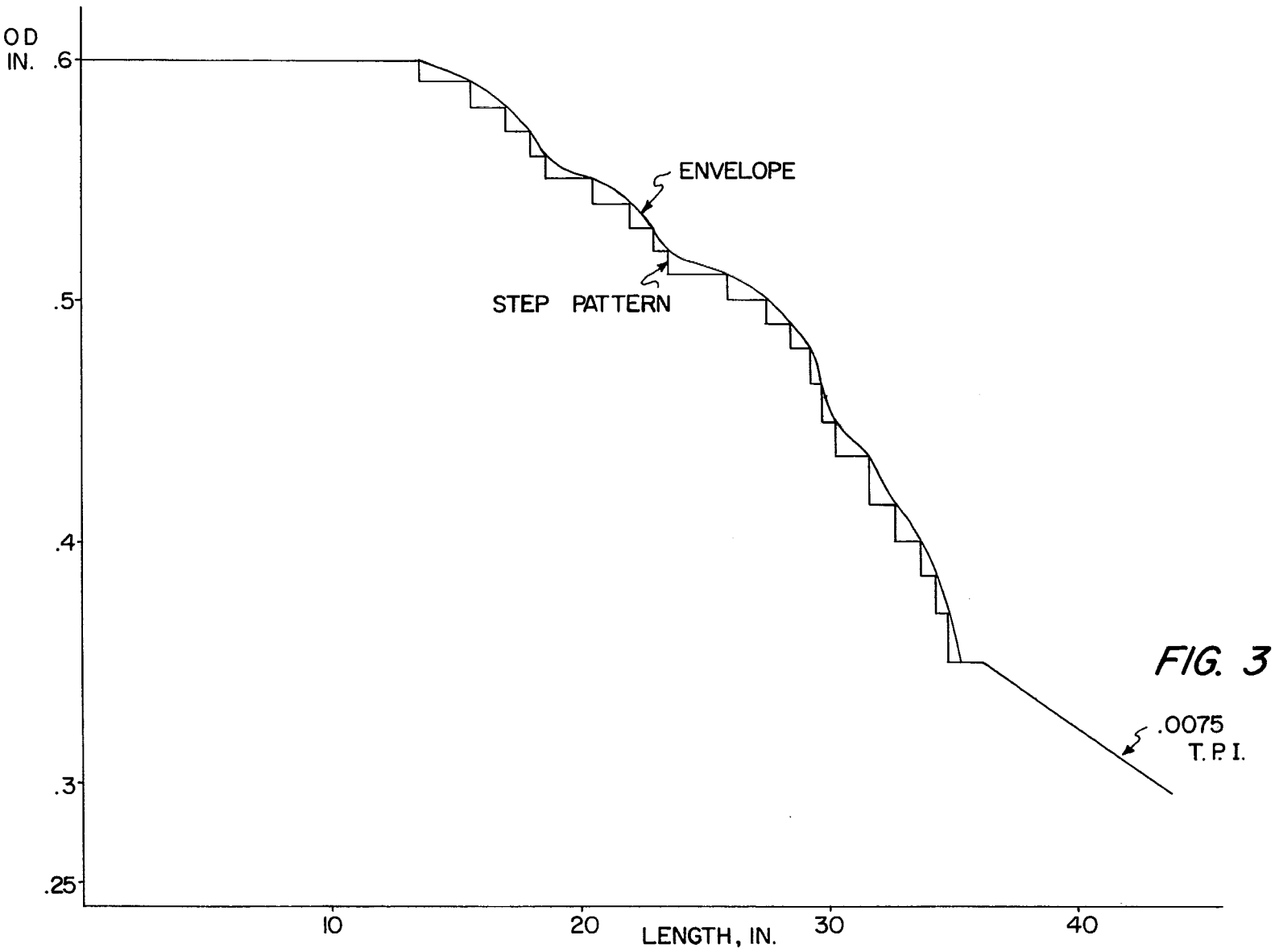
FIG. 3 is a graphical representation of the step pattern and of the shaft of FIG. 1, with a greatly exaggerated vertical scale, and showing the outer envelope of the step pattern.

As discussed in U.S. Pat. No. 4,169,595, the envelope of the step pattern characterizes the major physical effects of the step pattern on the shaft flex and other play characteristics of the shaft. As shown in FIG. 3, the envelope is formed by joining the shoulders of each step to form a smooth curve. Step patterns other than but similar to that shown in the drawing, providing they describe the same envelope, will have the same general flex and play characteristics.

We claim:

1. A light weight, hollow metal, golf club shaft tapered with a step pattern, having approximately the same deflection feel as conventional weight golf club shafts having the same stiffness characteristics, having a grip section including a grip portion at one end and weighing not more than about 2.9 ounces.

said shaft exclusive of the grip portion having a thin, substantially uniform, wall thickness, said shaft consisting of a metal having a yield strength after heat treatment of at least about 235000 lbs./in$^2$ and an ultimate strength of at least 265000 lbs./in.$^2$, said shaft being subject to a maximum bending moment in the grip section during play, the said grip section comprising a portion having a wall thickness greater than the wall thickness of the rest of the shaft in order to resist said bending moment, said portion of greater wall thickness comprising at least a part of the grip section, and wherein the entire grip section has the same outside diameter.

2. The shaft of claim 1 wherein the metal consists of AISI 6150 alloy steel.

3. The shaft of claim 2 wherein the shaft is tapered with the step pattern specified in FIG. 1.

4. The shaft of claim 2 wherein the shaft is tapered with a step pattern having an envelope which corresponds to the envelope of the step pattern specified in FIG. 1, said step patterns being different but similar.

5. The shaft of claim 1 wherein the shaft is tapered with the step pattern specified in FIG. 1.

6. The shaft of claim 1 wherein the shaft is tapered with a step pattern having an envelope which corresponds to the envelope of the step pattern specified in FIG. 1, said step patterns being different but similar.

* * * * *